US005224232A

United States Patent [19]

Zahuranec et al.

[11] Patent Number: 5,224,232

[45] Date of Patent: Jul. 6, 1993

[54] DUST PAN SIDE WALL FOR CARPET SWEEPER

[75] Inventors: Terry L. Zahuranec, Hudson; Craig M. Saunders, Rocky River, both of Ohio

[73] Assignee: Royal Appliance Mfg. Co., Cleveland, Ohio

[21] Appl. No.: 761,268

[22] Filed: Sep. 17, 1991

[51] Int. Cl.[5] ..... A47L 11/33

[52] U.S. Cl. ..... 15/41.1

[58] Field of Search ..... 15/41.1, 42–48, 15/48.1, 48.2, 79.1, 79.2, 52.1, 257.3

[56] References Cited

U.S. PATENT DOCUMENTS

| | | | |
|---|---|---|---|
| 226,512 | 4/1880 | Gates et al. . | |
| 435,251 | 8/1890 | Schumacher . | |
| 3,594,841 | 7/1971 | Kieves | 15/4 |
| 3,671,991 | 6/1972 | Fukuba | 15/41.1 |
| 3,924,285 | 12/1975 | Hukuba | 15/41.1 |
| 4,207,641 | 6/1980 | Liebscher et al. | 15/41.1 |
| 4,464,804 | 8/1984 | Hopkins | 15/41.1 |
| 4,701,969 | 10/1987 | Berfield et al. | 15/79 R |
| 4,864,674 | 9/1989 | Hamilton | 15/4 |

FOREIGN PATENT DOCUMENTS 20666 of 1913 United Kingdom .

*Primary Examiner*—Edward L. Roberts

*Attorney, Agent, or Firm*—Fay, Sharpe, Beall, Fagan, Minnich & McKee

[57] ABSTRACT

A carpet sweeper comprises a housing, brushes, wheels fixed to the housing, and a pivotable handle attached to the housing. The housing contains a plurality of sides, one of which is a flip-down door. The door has hinges along a bottom edge. The top edge comprises a tab which cooperates with the top of the housing to selectively secure the door in a closed position. The tab is selectively manually deformable outwardly and downwardly from the top of the housing to swing the door into an open position. The housing includes flanges to secure the trays within the housing.

17 Claims, 5 Drawing Sheets

DUST PAN SIDE WALL FOR CARPET SWEEPER

BACKGROUND OF THE INVENTION

I. Field of Invention

This invention relates generally to the art of carpet sweepers and more particularly to a carpet sweeper housing featuring a door which folds down for removing dust accumulated within the sweeper.

II. Description of Related Art

It is known in the art to provide a non-motorized sweeper which utilizes a gear mechanism to transfer power from wheels to brushes mounted within a housing of the sweeper. It is also known in the art to mount dust trays within a housing to collect the dust so gathered by the sweeper.

Although prior art sweeper designs have functioned generally satisfactorily, improvements were desired. For example, emptying dust collected by the sweeper is often a messy job during which some of the dust gathered by the sweeper is sometimes spilled onto the floor again. Second, the emptying of the dust gathered by the sweeper is sometimes inconvenient. Advantages would be obtainable if a sweeper could be designed which would effectively gather dirt and empty it in an effective and convenient manner. Third, some prior art dust trays were difficult to remove from the sweeper, if they were removable at all. Those that were removable sometimes were difficult to secure within the housing in an inexpensive yet effective way.

The present invention concerns a new and improved carpet sweeper which is simple, yet attractive in design. It is effective in use, gathering dust while providing for easy emptying of the dust from the associated dust trays. As such, the design overcomes the foregoing difficulties and others while providing better and more advantageous overall results.

SUMMARY OF THE INVENTION

In accordance with the present invention, a new and improved carpet sweeper is provided which features a flip-down door.

More particularly, in accordance with the invention, the sweeper includes a housing having a plurality of sides. One of the sides comprises a flip-down door. The door has a top and bottom edge. The bottom edge is hingedly affixed to the housing. The top edge comprises a tab. The tab cooperates with a recess in the top of the housing to secure the door in a closed position. The door is selectively swingable outwardly from the housing about the hinged bottom edge to an open position. The carpet sweeper also comprises brushes contained within the housing, wheels mounted to the housing, and a handle having a lower end which is attached to the housing. The door is selectively swingable outwardly from the housing by manually elastically deforming the tab outwardly from the housing.

The carpet sweeper can also comprise a bumper around the side surfaces of the housing including the door. The sweeper can also comprise a tray slidably mounted within the housing and selectively removable from the housing through an opening in the housing created by swinging the door to an open position. The tray can also comprise inward and outward side walls and distal and proximate end walls. Tabs on an interior surface of the door help secure the tray within the housing when the door is in the closed position.

One advantage of the present invention is the provision of a new and improved carpet sweeper.

Another advantage of the present invention is the provision of a carpet sweeper with a flip-down side door. Because the door swings open, the sweeper may be emptied by tilting it over an appropriate receptacle, such as a dust bin.

Still another advantage of the present invention is the provision of a carpet sweeper with a flip-down side door and dust trays which are removable by sliding them out of the housing.

Still another advantage of the present invention is the provision of a low cost carpet sweeper having an attractive appearance. Because the sweeper has a minimum number of parts, it lends itself easily to injection molding in plastic. If plastic is used, a variety of attractive colors may be used and the housing itself can be made with a relatively low cost.

Still other advantages are associated with the swingable flip-down door of the carpet sweeper according to the present invention. The door is easily opened by manually deforming a door tab outwardly and downwardly around a hinged door bottom edge. Because of the hinge design and tab design, the flip-down door is durable, inexpensive, attractive in appearance, and easy to use. Because there are no moving parts other than the door itself, manufacturing and inventory costs are low and reliability and durability are high.

Still other benefits and advantages of the present invention will become apparent to those skilled in the art to which it pertains upon a reading and understanding of the following detailed specification.

BRIEF DESCRIPTION OF THE DRAWINGS

The invention described herein may take physical form in certain parts and arrangement of parts. A preferred embodiment of the invention will be described in detail in this specification and will be illustrated in the accompanying drawings. Those drawings form a part of this disclosure wherein.

DESCRIPTION OF THE PREFERRED EMBODIMENT

Figure 1:
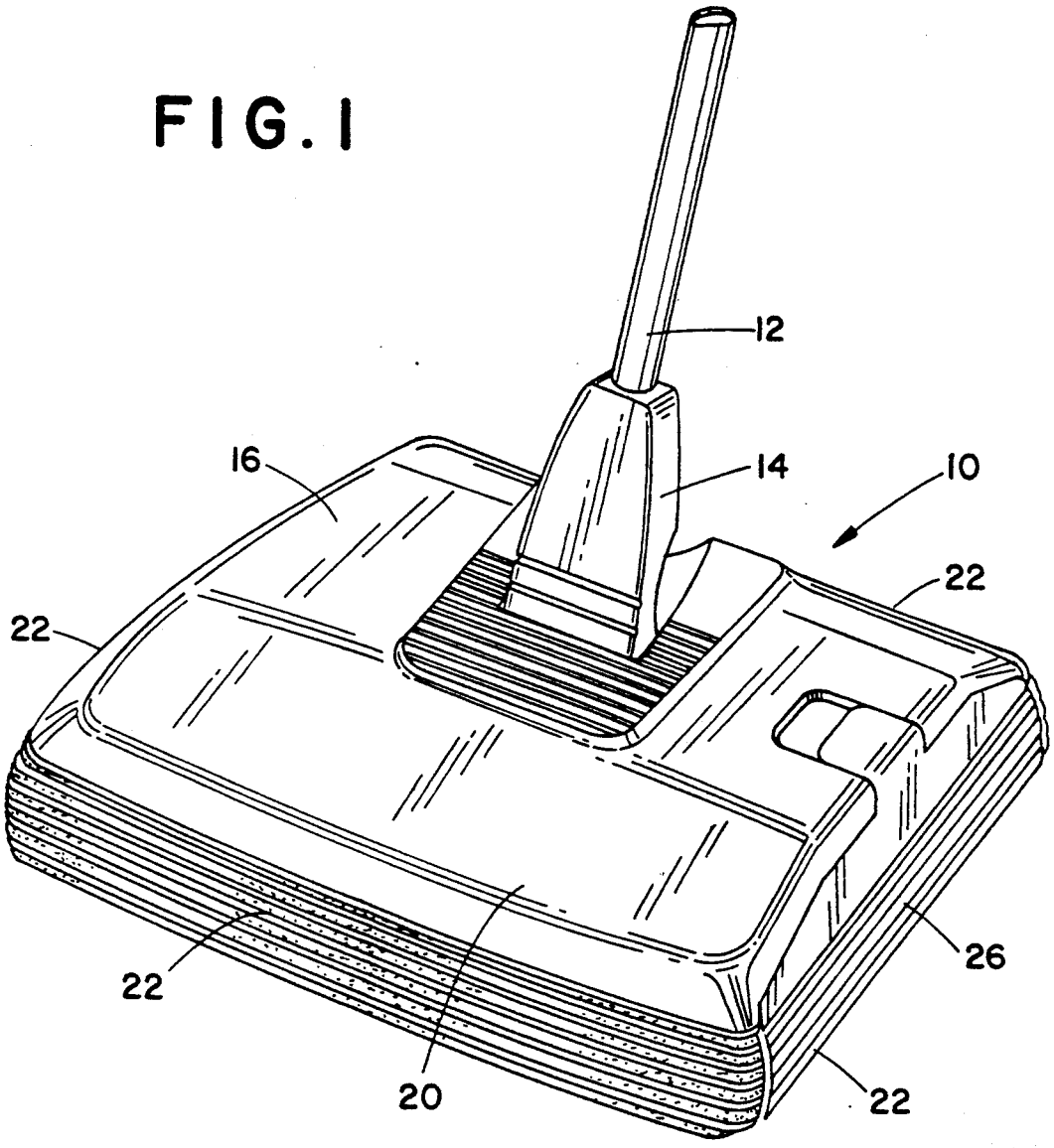
FIG. 1 is a perspective view of a sweeper according to the present invention.

Referring now to the drawings, wherein the showings are for purposes of illustrating a preferred embodiment of the invention only, and should not be understood to limit the invention to the specific design illustrated therein, FIG. 1 shows a sweeper 10 according to the present invention. The sweeper 10 comprises a handle 12, having a lower end 14 which is pivotably attached to a top 16 of a housing 20 of the sweeper 10 and an upper end (not shown) which is typically gripped by the user as the user pushes and pulls the sweeper 10 across the surface to be cleaned. The lower end 14 of the handle 12 is pivotably attached to the top 16 of the sweeper housing 20 to keep the sweeper 10 parallel to the floor while the user pushes and pulls the sweeper across the floor. The housing 20 comprises the top 16 and depending sides 22. One of the sides 22 comprises a flip-down door 26 which will be discussed later in this specification. Around the edges of the sides 22 is a bumper 28 which is preferably made of a soft elastomeric material.

Figure 2:
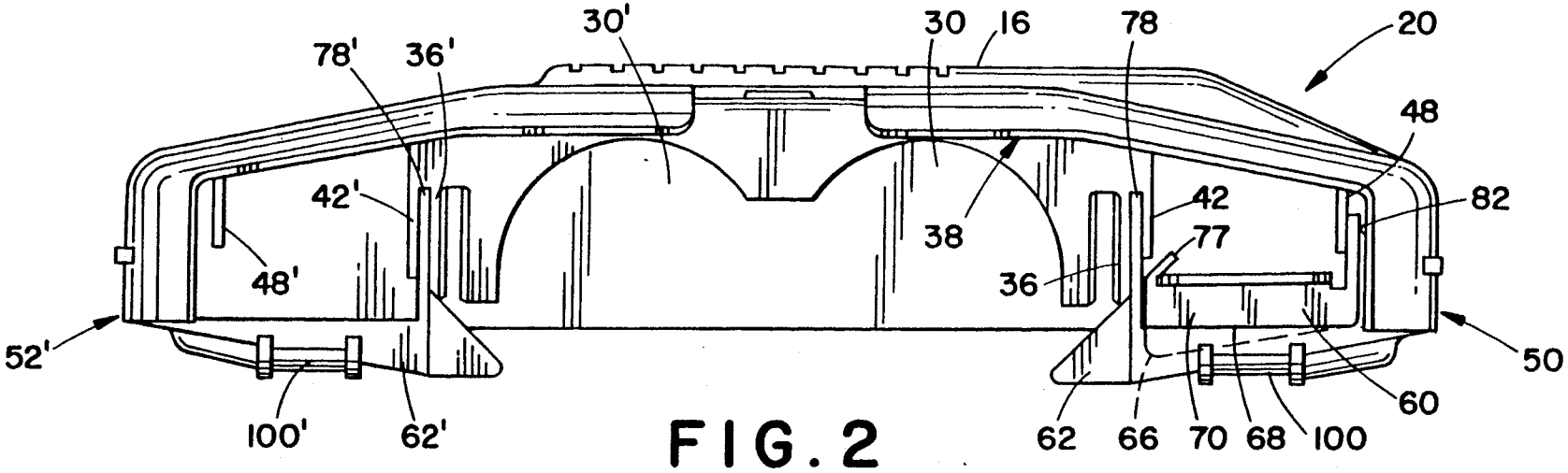
FIG. 2 is a side view of a sweeper housing according to the present invention with the flip-down door and one of the slide trays removed.
Figure 3:
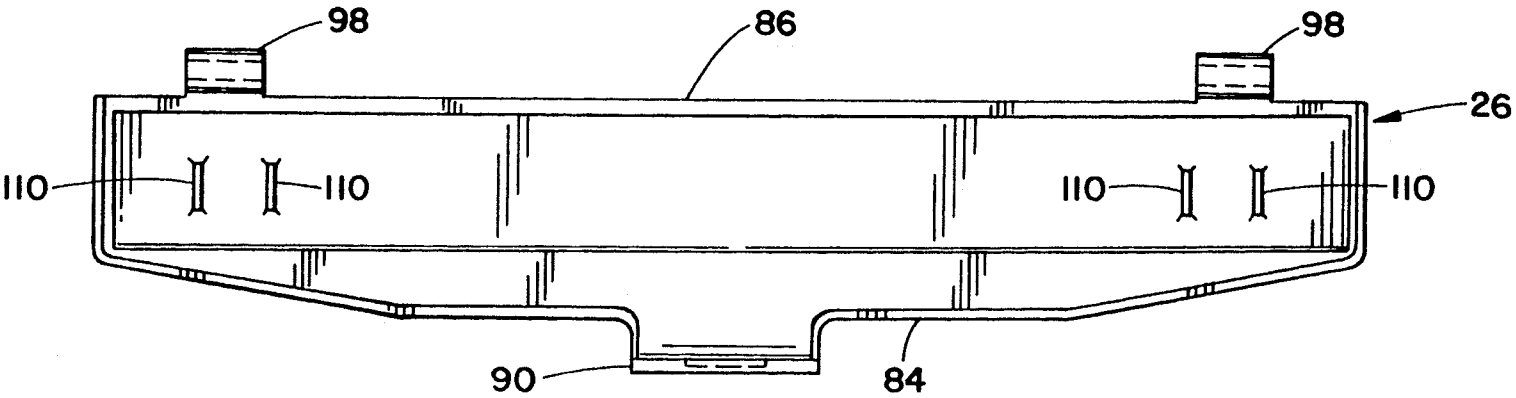
FIG. 3 is a plan view of the interior surface of the flip-down door.
Figure 4:
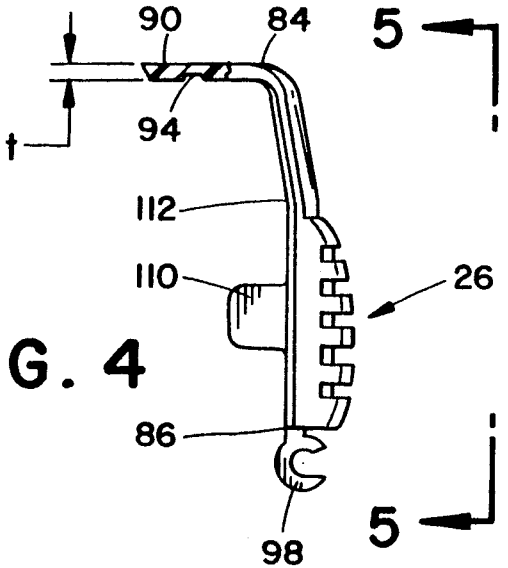
FIG. 4 is a side view of the flip-down door.
Figure 5:
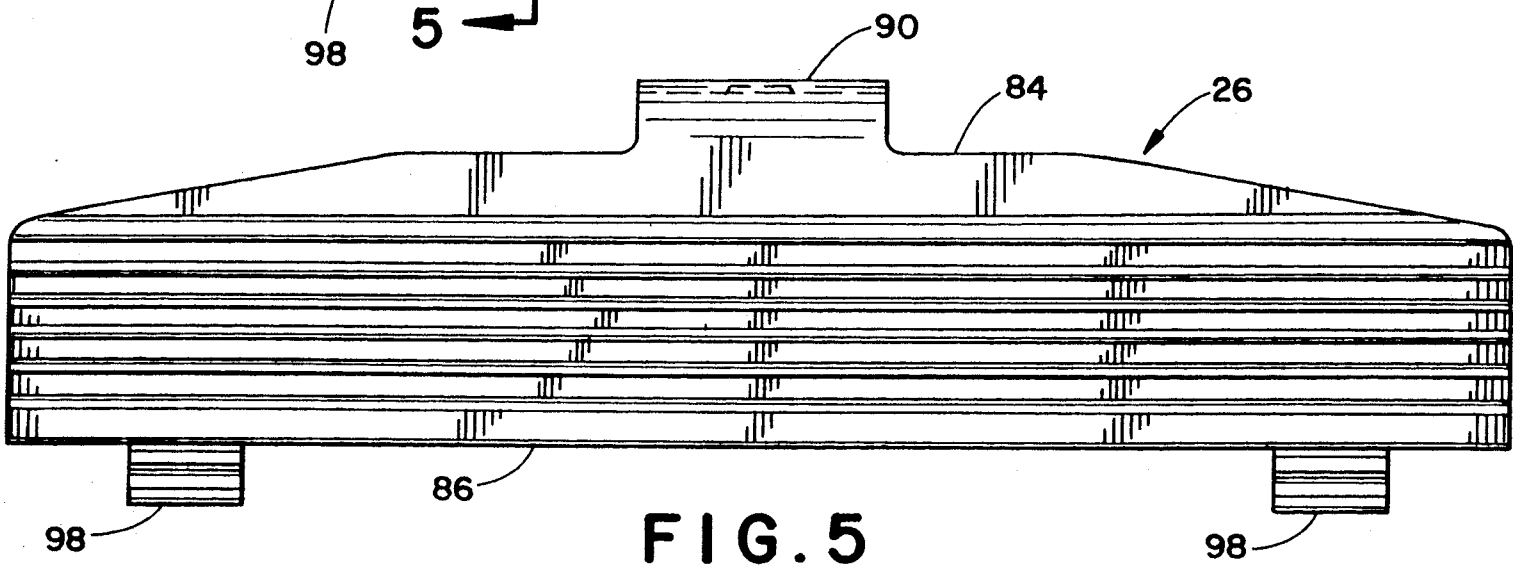
FIG. 5 is a plan view of the outside surface of the flip-down door.

With reference to FIG. 2, the features of the first side 50 of the housing 20 are mirrored on a second side 52 of the housing 20. Therefore, features on the second side 52 which correspond to features on the first side 50 will be designated by a primed (') suffix and the operation of the invention will be discussed by reference to only one side of the sweeper 10. With continuing reference to FIG. 2, the interior of the housing 20 includes a pair of recesses 30 which receive brushes (not shown). The housing 20 further comprises a first central flange 36 which extends downwardly from an inner surface 38 of the top 16 of the housing 20 adjacent the recess 30. The top 16 of the housing 20 also comprises a spaced second central flange 42. The second central flange 42 also extends downwardly from the inner surface 38 of the top 16 of the housing 20 and extends generally parallel to the first central flange 36.

A peripheral flange 48 also extends downwardly from the inner surface 38 of the top 16 of the housing 20 and also extends generally parallel to the first and second central flanges 36, 42. The peripheral flange 48 is located generally parallel to a first side wall 51 of the housing 20. The first side 50 of the housing 20 is illustrated as having a selectively slidable dust tray 60 inserted into the housing 20 in its intended position. On the second side 52 of the housing 20, the housing 20 is illustrated with the tray 60 removed.

The housing 20 also features a base 62 which serves as a floor under the tray 60. The base 62 selectively receives the tray 60. In one embodiment, the base 62 receives dust collected by the sweeper 10 and trays 66 are not used. During insertion of the tray 60 within the housing 20, the tray 60 is slid over a lip 68 of the base 62. After a proximate end wall 70 of the tray 60 clears the lip 68, the tray 60 can be pushed down into and received by the base 62. The lip 68 helps secure the tray 60 within the housing 20 to prevent the tray 60 from sliding out of the housing 20 upon tilting or other such maneuvers.

Figure 6:
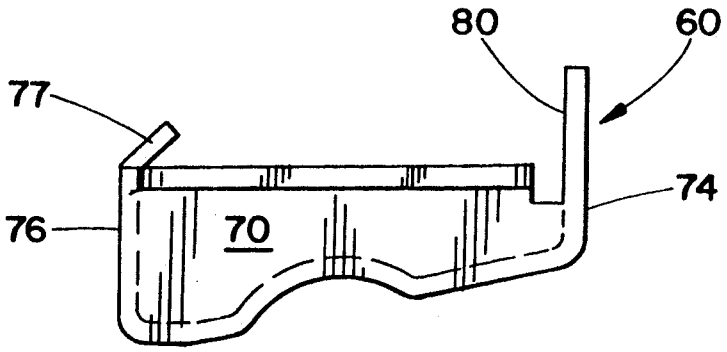
FIG. 6 is an end view of a removable slide tray according to the invention.
Figure 7:
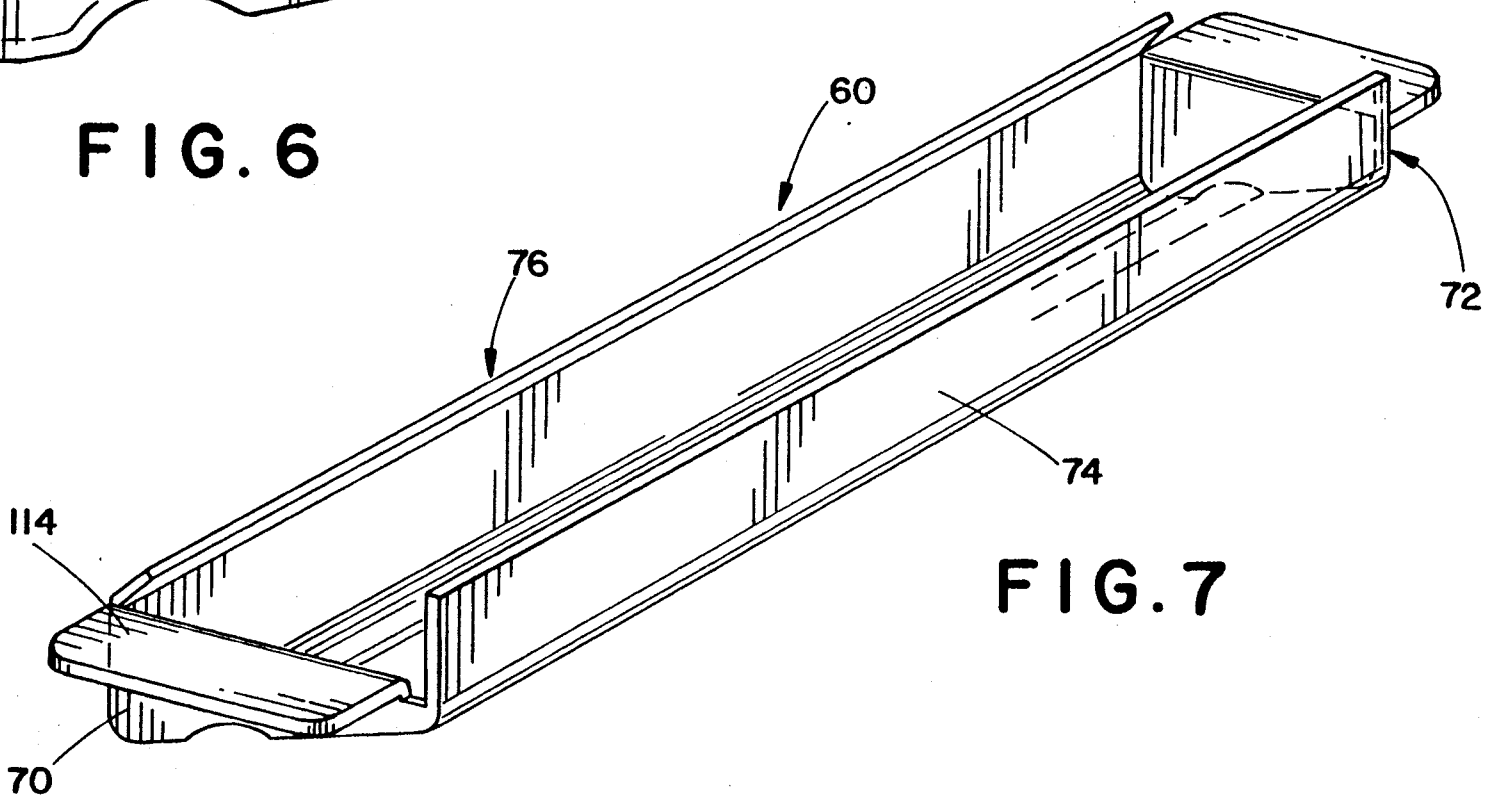
FIG. 7 is a perspective view of a slide tray according to the invention; and, FIG. 8 is an enlarged perspective view of the top of the sweeper housing with the flip-down door removed to show a recess and shelf.

With reference to FIGS. 6 and 7, the tray 60 comprises the proximate end wall 70, a distal end wall 72, an outer side wall 74, and an inner side wall 76. The flanges 36, 42, 48 cooperate with the side walls 74, 76 of the tray to help secure the tray 60 within the housing 20. For example, an interior surface 80 of the outer side wall 74 is selectively received between the peripheral flange 48 and an interior surface 82 of the first side wall 51 of the housing 20. Likewise, the inner side wall 76 of tray 60 features an angled surface 77 which is received beneath the second central flange 42. A vertical extension 78 of an inner side wall of the base 62 is received between first and second central flanges 36, 42. The housing flanges 36, 42, 48 cooperate with the side walls 74, 76, of the tray 60, as well as with the recess 66 in the base 62 and the lip 68 to secure the tray 60 within the housing 20.

Figure 8:
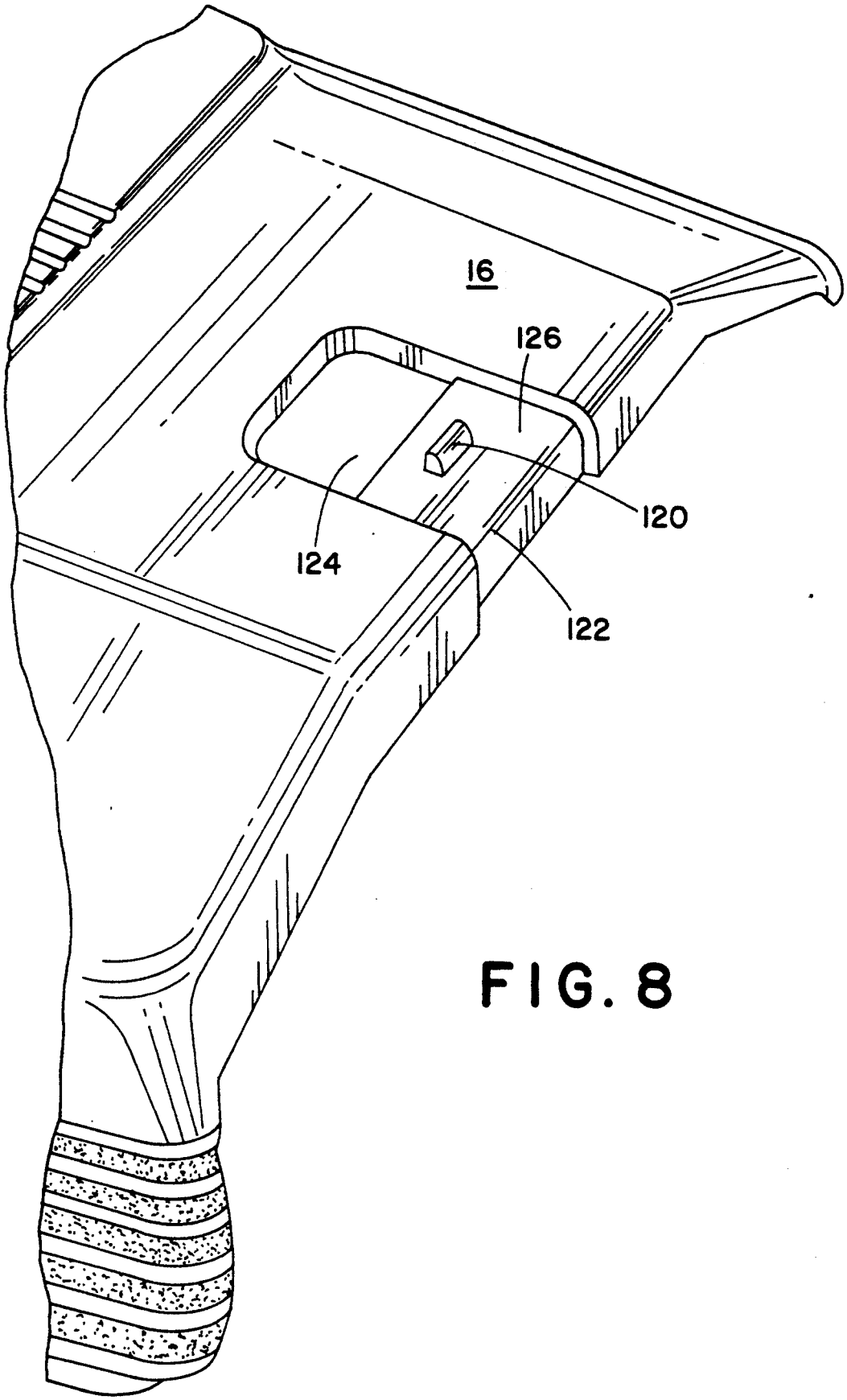

With reference now to FIGS. 2–5 and 8, the operation of the flip-down door 26 will be explained. The door 26 has a top edge 84 and a bottom edge 86. The top edge 84 comprises a tab 90 which extends substantially normal to the plane of the door 26. The tab 90 cooperates with the top 16 of the housing 20 to secure the door 26 in a closed position such as is illustrated in FIG. 1. In the preferred embodiment, this securement is accomplished by the means of a slot 94 which cooperates with a small ledge 120 on the housing 20. As shown in FIG. 8, the ledge 120 is located on shelf 122 which is elevated slightly above a recess 124 in the top 16 of the housing 20. The distance between a top surface 126 of the shelf 122 and the surface of the top 16 of the housing is approximately equal to the wall thickness "t" of the tab 90. By configuring the shelf 122 and tab in this way, the tab 90 fits flush with the surface of the housing 20, providing the attractive appearance shown in FIG. 1.

The tab 90 is easily deformable outwardly and upwardly from the top 16 of the housing 20 to release the ledge 120 from slot 94. This deformation is easily accomplished by manually generated force, such as generatable by a user's hands. The recess 124 receives the fingertips of a user's hands, enabling the user to grip tab 90 and deflect it outwardly and downwardly. In the event that tab 90 is deformed in this manner, door 26 can rotate outwardly and downwardly about hinges 98 to an open position. The hinges cooperate with pins 100 which are mounted on the housing 20, as is shown in FIG. 2.

When the door 26 is an open position, the tray 60 is easily emptied, whether by tilting the housing 20 and shaking the dust out of the tray 60, or by sliding the tray 60 out of the base 62 and emptying it in an appropriate manner. If the tray 60 is removed, it is easily slid back into housing 20 and secured by means of the flanges 36, 42, 48 and the lips 68 as already discussed.

Another method of securing the tray 60 within the housing 20 is by the use of tabs 110. In the preferred embodiment, tabs 110 are located on an interior surface 112 of the door 26. When the door 26 is swung to the closed position, tabs 110 rest against an outer shelf 114 of tray 60, as is seen best in FIG. 7. In this manner, tabs 110 work in conjunction with the other features of the housing 20 to secure the trays 60 within the housing 20.

The invention has been described with reference to a preferred embodiment. Obviously, modifications and alterations will occur to others upon a reading and understanding of this specification and drawings. It is intended to include all such modifications and alterations insofar as they come within the scope of the appended claims or the equivalents thereof.

We claim:

1. A carpet sweeper comprising:

a housing having a plurality of sides, one of said sides comprising a flip-down door, said door having top and bottom edges, said bottom edge being hingedly affixed to said housing, said top edge comprising a tab, said tab cooperating with said housing to secure said door in a closed position, means in said housing to collect dust from a sweeping means, said door selectively swingable outwardly from said housing about said hinged bottom edge to an open position to provide for discharge of dust from said collecting means; and, a pivoting handle having a lower end attached to said housing.

2. The carpet sweeper as in claim 1 wherein said door is selectively swingable outwardly from said housing by manually elastically deforming said tab outwardly from said housing.

3. The carpet sweeper as in claim 1 further comprising:

a bumper around said side surfaces of said housing, said bumper extending about each side surface of said housing including said door.

4. The carpet sweeper of claim 1 wherein said collecting means comprises:

a tray slidably mounted in said housing and being selectively removable from said housing, said tray being removable through an opening in said housing created by swinging said door to said open position.

5. The carpet sweeper of claim 4 further comprising:

tabs on an interior surface of said door, said tabs securing said tray within said housing when said door is in said closed position.

6. The carpet sweeper of claim 1 wherein said housing further comprises:

a top, said top having a recess to selectively receive said tab.

7. The carpet sweeper of claim 6 wherein said recess comprises:

a shelf, said shelf having a top surface disposed inwardly of said top of said housing a distance approximately equal to a wall thickness of said tab.

8. The carpet sweeper of claim 6 wherein said recess comprises:

a shelf, said shelf being closer to an outer surface of said top than said recess.

9. The carpet sweeper of claim 8 wherein said recess selectively receives a user's fingers when the user is manually deflecting said tab outwardly.

10. The carpet sweeper of claim 6 wherein said recess comprises:

a shelf, said shelf having a ledge protruding upwardly from a top surface of said shelf, said shelf selectively received in a slot in said tab.

11. A carpet sweeper comprising:

a housing, said housing having a plurality of sides, a top, and a base, one of said sides being a door, said housing having a first central flange extending downwardly from an inner surface of said housing and extending perpendicularly to said door, a vertical extension extending upwardly from said base;

a second central flange extending downwardly from said inward surface of said housing, said second central flange being spaced from and parallel to said first central flange, said central flanges receiving therebetween said vertical extension from said base;

a sweeping means;

a means in said housing to collect dust from said sweeping means;

said first central flange, said second central flange, and said vertical extension acting in combination to secure said collecting means;

a removable slide tray, said tray being selectively removable from said housing through said door, said tray having inner and outer side walls and first and second end walls, when said tray is within said housing said first central flange fitting adjacent said inward side wall; and, a pivotable handle connected to said top of said housing.

12. The carpet sweeper of claim 11 wherein said base has a lip formed by an end wall, said lip abutting a wall of said recess and securing said tray within said housing so that said housing may be tilted to empty said slide tray.

13. A carpet sweeper comprising:

a housing, said housing having a plurality of sides, a top, and a base, one of said sides being a door, said housing having a peripheral flange extending downwardly from an inner surface of said housing and extending generally perpendicularly to said door;

a sweeping means;

a means in said housing to collect dust from said sweeping means;

a dust tray slidably mounted in said housing, said dust tray being removable from said housing through said door, said dust tray having inner and outer side walls and distal and proximate end walls, when said dust tray is within said housing, said peripheral flange being located adjacent an interior surface of said dust tray outer side wall to secure said dust tray within said housing.

14. The carpet sweeper of claim 13 wherein said peripheral flange is spaced from and generally parallel to a first side of said housing, and wherein said dust tray outer side wall is received between said first side of said housing and said peripheral flange.

15. The carpet sweeper of claim 13 wherein said base has a lip formed by an end wall, said lip abutting a wall of said recess and securing said tray within said housing so that said housing may be tilted to empty said slide tray.

16. The carpet sweeper of claim 13 further comprising:

a pivotable handle connected to said top of said housing.

17. In a carpet sweeper having a housing containing brushes, a gear mechanism to transfer power from wheels to said brushes, a removable dust tray, and a pivotable handle connected to said housing, the improvement comprising:

said housing having a plurality of sides, one of said sides comprising a flip down door, said door having top and bottom edges, said bottom edge being hingedly fixed to said housing, said top edge comprising a tab, said tab cooperating with said housing to secure said door in a closed position, said door selectively swingable outwardly from said housing about said hinged bottom edge to an open position.

* * * * *